US006644050B2

(12) United States Patent
Shim

(10) Patent No.: US 6,644,050 B2
(45) Date of Patent: Nov. 11, 2003

(54) AIR CONDITIONING SYSTEM AND METHOD FOR CONTROLLING THE SAME

(75) Inventor: Min Seob Shim, Kunpo-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/061,169

(22) Filed: Feb. 4, 2002

(65) Prior Publication Data

US 2003/0070439 A1 Apr. 17, 2003

(30) Foreign Application Priority Data

Oct. 15, 2001 (KR) ..... 2001/63355
Oct. 15, 2001 (KR) ..... 2001/63356

(51) Int. Cl.[7] ..... F25B 7/00; G05D 23/00
(52) U.S. Cl. ..... 62/175; 236/51
(58) Field of Search ..... 62/175; 236/51; 165/205, 207, 208, 209; 340/825.52

(56) References Cited

U.S. PATENT DOCUMENTS 5,383,336 A * 1/1995 Nishida et al. ..... 62/115
5,390,506 A * 2/1995 Sogabe et al. ..... 62/175
5,435,147 A * 7/1995 Mochizuki et al. ..... 62/175
5,499,510 A * 3/1996 Yoshida et al. ..... 62/175
5,522,230 A * 6/1996 Shima et al. ..... 62/127
5,592,824 A * 1/1997 Sogabe et al. ..... 62/127
5,603,225 A * 2/1997 Tobi et al. ..... 62/175
5,630,324 A * 5/1997 Yoshida et al. ..... 62/175
5,647,223 A * 7/1997 Wada et al. ..... 62/175
5,853,123 A * 12/1998 Okano et al. ..... 236/51
6,126,080 A * 10/2000 Wada ..... 236/51
6,290,141 B1 * 9/2001 Park et al. ..... 236/51
6,453,689 B2 * 9/2002 Wada ..... 62/175

* cited by examiner

*Primary Examiner*—Marc Norman
(74) *Attorney, Agent, or Firm*—Birch, Stewart, Kolasch & Birch, LLP

(57) ABSTRACT

An air conditioning system (multi-air conditioner system) which has a plurality of indoor units installed inside of a predefined space for performing air conditioning and an outdoor unit installed outside of the space for controlling the indoor units, and a method for controlling the same. In an installation process, an installer need not personally set addresses in the indoor units one by one, because the outdoor unit automatically sets the addresses in the indoor units. Therefore, as compared with conventional air conditioning systems, a period of time required for the address setting and an error occurrence probability can be reduced and the convenience to the user can be increased. Furthermore, the address setting can automatically be conducted without additionally using separate hardware modules, thereby reducing parts costs required in manufacturing a multi-air conditioner.

8 Claims, 10 Drawing Sheets

FIG. 9a

| ① | ② | ③ | ④ | ⑤ | ⑥ |
|---|---|---|---|---|---|
| | | | | 0 | 0 |
| | | | | 0 | 1 |
| | | | | 1 | 0 |
| | | | | 1 | 1 |
| | | | | 2 | 0 |
| | | | | 2 | 1 |
| | | | | 3 | 0 |
| | | | | 3 | 1 |
| | | | | 4 | 0 |
| | | | | 4 | 1 |
| | | | | 5 | 0 |
| | | | | 5 | 1 |
| | | | | 6 | 0 |
| | | | | 6 | 1 |
| | | | | 7 | 0 |
| | | | | 7 | 1 |
| | | | | 8 | 0 |
| | | | | 8 | 1 |
| | | | | 9 | 0 |
| | | | | 9 | 1 |

FIG. 9b

| ① | ② | ③ | ④ | ⑤ | ⑥ |
|---|---|---|---|---|---|
| | | 0 | 0 | | |
| | | 0 | 1 | | |
| | | 1 | 0 | | |
| | | 1 | 1 | | |
| | | 2 | 0 | | |
| | | 2 | 1 | | |
| | | 3 | 0 | | |
| | | 3 | 1 | | |
| | | 4 | 0 | | |
| | | 4 | 1 | | |
| | | 5 | 0 | | |
| | | 5 | 1 | | |
| | | 6 | 0 | | |
| | | 6 | 1 | | |
| | | 7 | 0 | | |
| | | 7 | 1 | | |
| | | 8 | 0 | | |
| | | 8 | 1 | | |
| | | 9 | 0 | | |
| | | 9 | 1 | | |

FIG. 9c

| ① | ② | ③ | ④ | ⑤ | ⑥ |
|---|---|---|---|---|---|
| 0 | 0 | | | | |
| 0 | 1 | | | | |
| 1 | 0 | | | | |
| 1 | 1 | | | | |
| 2 | 0 | | | | |
| 2 | 1 | | | | |
| 3 | 0 | | | | |
| 3 | 1 | | | | |
| 4 | 0 | | | | |
| 4 | 1 | | | | |
| 5 | 0 | | | | |
| 5 | 1 | | | | |
| 6 | 0 | | | | |
| 6 | 1 | | | | |
| 7 | 0 | | | | |
| 7 | 1 | | | | |
| 8 | 0 | | | | |
| 8 | 1 | | | | |
| 9 | 0 | | | | |
| 9 | 1 | | | | |

FIG. 10a

| ① | ② |
|---|---|

| ③ | ④ |
|---|---|
| 0 | 0 |
| 0 | 1 |
| 1 | 0 |
| 1 | 1 |
| 2 | 0 |
| 2 | 1 |
| 3 | 0 |
| 3 | 1 |
| 4 | 0 |
| 4 | 1 |
| 5 | 0 |
| 5 | 1 |
| 6 | 0 |
| 6 | 1 |
| 7 | 0 |
| 7 | 1 |
| 8 | 0 |
| 8 | 1 |
| 9 | 0 |
| 9 | 1 |

X

| ⑤ | ⑥ |
|---|---|
| 0 | 0 |
| 0 | 1 |
| 1 | 0 |
| 1 | 1 |
| 2 | 0 |
| 2 | 1 |
| 3 | 0 |
| 3 | 1 |
| 4 | 0 |
| 4 | 1 |
| 5 | 0 |
| 5 | 1 |
| 6 | 0 |
| 6 | 1 |
| 7 | 0 |
| 7 | 1 |
| 8 | 0 |
| 8 | 1 |
| 9 | 0 |
| 9 | 1 |

FIG. 10b

| ① | ② |
|---|---|
| 0 | 0 |
| 0 | 1 |
| 1 | 0 |
| 1 | 1 |
| 2 | 0 |
| 2 | 1 |
| 3 | 0 |
| 3 | 1 |
| 4 | 0 |
| 4 | 1 |
| 5 | 0 |
| 5 | 1 |
| 6 | 0 |
| 6 | 1 |
| 7 | 0 |
| 7 | 1 |
| 8 | 0 |
| 8 | 1 |
| 9 | 0 |
| 9 | 1 |

X

| ③ | ④ | ⑤ | ⑥ |
|---|---|---|---|
| 0 | 0 | 0 | 0 |
| 0 | 1 | 0 | 1 |
| 1 | 0 | 1 | 0 |
| 1 | 1 | 1 | 1 |
| 2 | 0 | 2 | 0 |
| 2 | 1 | 2 | 1 |
| 3 | 0 | 3 | 0 |
| 3 | 1 | 3 | 1 |
| 4 | 0 | 4 | 0 |
| 4 | 1 | 4 | 1 |
| 5 | 0 | 5 | 0 |
| 5 | 1 | 5 | 1 |
| 6 | 0 | 6 | 0 |
| 6 | 1 | 6 | 1 |
| 7 | 0 | 7 | 0 |
| 7 | 1 | 7 | 1 |
| 8 | 0 | 8 | 0 |
| 8 | 1 | 8 | 1 |
| 9 | 0 | 9 | 0 |
| 9 | 1 | 9 | 1 |

AIR CONDITIONING SYSTEM AND METHOD FOR CONTROLLING THE SAME

BACKGROUND OF THE INVENTION

1. Field of the Invention

The present invention relates to an air conditioning system and a method for controlling the same, and more particularly to an air conditioning system which is capable of simply and conveniently setting and controlling a plurality of indoor units installed inside of a predefined space and an outdoor unit installed outside of the space for controlling the indoor units, and a method for controlling the same.

2. Description of the Related Art

Generally, a multi-air conditioner signifies an air conditioning system consisting of one outdoor unit and a plurality of indoor units. For the purpose of attaining an efficient operation of the multi-air conditioner, the outdoor unit must be able to identify the plurality of indoor units, respectively, to control them.

For identification, the plurality of indoor units are typically assigned, respectively, numbers, or addresses. For example, the indoor units may be numbered 1, 2, 3, . . . , n. The outdoor unit can exchange data with the plurality of indoor units by recognizing their respective numbers.

An example of conventional constructions for transmission and reception of data between an outdoor unit and a plurality of indoor units assigned numbers as mentioned above is shown in FIG. 1, which is a block diagram of a conventional air conditioning system. As shown in this drawing, the conventional air conditioning system comprises an outdoor unit 1, and a plurality of indoor units 2 each connected to the outdoor unit 1 via a communication line 5. The outdoor unit 1 includes a microcomputer 3 for controlling the entire operation of the outdoor unit 1, and each of the indoor units 2 includes a microcomputer 4 for controlling the entire operation of a corresponding one of the indoor units 2.

The outdoor unit 1 and each of the indoor units 2 exchange control information and various control signals, such as ON/OFF signals, with each other over the communication line 5. In particular, the outdoor unit 1 recognizes numbers assigned respectively to the plurality of indoor units, so as to determine which one of the indoor units currently exchanges data therewith. In other words, the outdoor unit can control the plurality of indoor units individually owing to the previous recognition of information about respective numbers and positions of the indoor units. As a result, the outdoor unit can control a specific one of the indoor units with, for example, the ON signal on the basis of a number and position of the specific indoor unit.

A dip switch 6 is conventionally provided in each of the indoor units 2 to set a number of a corresponding one of the indoor units 2 to be recognized by the outdoor unit 1. An installer sets a number in each indoor unit using the dip switch 6 on the spot where each indoor unit is installed. Once a corresponding number is set by means of the dip switch 6, each of the indoor units 2 transfers information regarding the set number to the microcomputer 3 of the outdoor unit 1. As a result, the outdoor unit microcomputer 3 can control a specific one of the plurality of indoor units by recognizing the set numbers of the indoor units, respectively.

In the above-mentioned air conditioning system, however, the installer must personally assign the respective numbers to the plurality of indoor units using the dip switches. For this reason, a larger number of indoor units may result in a higher probability for the installer to manipulate the dip switches erroneously, causing indoor unit numbers to be duplicated or misread.

Further, each dip switch is mounted directly to a corresponding indoor unit in a hardware manner, resulting in an increase in parts costs. Furthermore, the indoor unit must have a separate microcomputer port for receiving information set by the installer using the dip switch. Thus, there is considerable difficulty in developing such an indoor unit.

Moreover, a larger number of indoor units increases the number of digits of numbers to be set therein. In this case, each indoor unit has to be equipped with a dip switch capable of setting a larger number, which leads to an increase in the number of ports of the microcomputer in the indoor unit, connected to the dip switch, and in turn necessitates the replacement of the indoor unit microcomputer with a high-price chip.

SUMMARY OF THE INVENTION

Therefore, the present invention has been made in view of the above problems, and it is an object of the present invention to provide an air conditioning system with a plurality of indoor units and an outdoor unit, which is capable of avoiding address duplication, error occurrence, etc. when an installer sets respective addresses in the plurality of indoor units, reducing manufacturing costs of the indoor units and simply and accurately setting the respective addresses in the indoor units in a software manner, and a method for controlling the same.

In accordance with one aspect of the present invention, the above and other objects can be accomplished by the provision of an air conditioning system comprising a plurality of indoor units each adapted to suck indoor air, perform a heat exchange operation for the sucked indoor air with a heat exchange medium and discharge the heat-exchanged air, each of the indoor units including a production number storage area defined in a memory which is installed to prevent a corresponding one of the indoor units from being subject to a data loss when a power failure occurs, the production number storage area storing information about a unique production number assigned to the corresponding indoor unit in a manufacturing process thereof; and an outdoor unit connected in common to the plurality of indoor units and adapted to perform a heat exchange operation for the heat exchange medium with external air, the outdoor unit setting addresses in the indoor units to control them, respectively.

In accordance with another aspect of the present invention, there is provided a method for controlling an air conditioning system, comprising the steps of a) storing in a plurality of indoor units information about unique production numbers assigned respectively to the indoor units in manufacturing processes thereof; b) allowing an outdoor unit controlling the plurality of indoor units, to recognize the production number information stored in the indoor units digit by digit; c) allowing the outdoor unit to set addresses in the indoor units, respectively, on the basis of the production number information if all the production number information have been recognized at the step b); and d) transmitting and receiving data between the outdoor unit and the indoor units on the basis of the addresses set by the outdoor unit at the step c).

In accordance with yet another aspect of the present invention, there is provided a method for controlling an air conditioning system, comprising the steps of a) storing in a plurality of indoor units information about unique production numbers assigned respectively to the indoor units in manufacturing processes thereof; b) allowing an outdoor unit controlling the plurality of indoor units, to recognize the production number information stored in the indoor units digit by digit; c) allowing the outdoor unit to combine the recognized production number information and then determine which one of the production numbers of the indoor units is equal to the combined result; d) if it is determined at the step c) that a specific one of the production numbers of the indoor units is equal to the combined result, allowing the outdoor unit to set an address in any one of the indoor units, corresponding to the specific production number; e) allowing the outdoor unit to assign the set address to the indoor unit corresponding to the specific production number; f) repeating the steps c) to e) until all the indoor units are assigned addresses; and g) allowing the outdoor unit to control the indoor units on the basis of the addresses assigned thereto.

BRIEF DESCRIPTION OF THE DRAWINGS

The above and other objects, features and other advantages of the present invention will be more clearly understood from the following detailed description taken in conjunction with the accompanying drawings, in which:

FIG. 9*a* is a view illustrating in a bar form the recognition of fifth and sixth digit values of a production number of each indoor unit by an outdoor unit according to the control method of FIG. 8;

FIG. 9*b* is a view illustrating in a bar form the recognition of third and fourth digit values of the production number of each indoor unit by the outdoor unit according to the control method of FIG. 8;

FIG. 9*c* is a view illustrating in a bar form the recognition of first and second digit values of the production number of each indoor unit by the outdoor unit according to the control method of FIG. 8;

FIG. 10*a* is a view illustrating in a bar form the combination of a least significant byte number with a middle byte number by the outdoor unit according to the control method of FIG. 8; and FIG. 10*b* is a view illustrating in a bar form the combination of a most significant byte number with the combined result of FIG. 10*a* by the outdoor unit according to the control method of FIG. 8.

DESCRIPTION OF THE PREFERRED EMBODIMENTS

Figure 1:
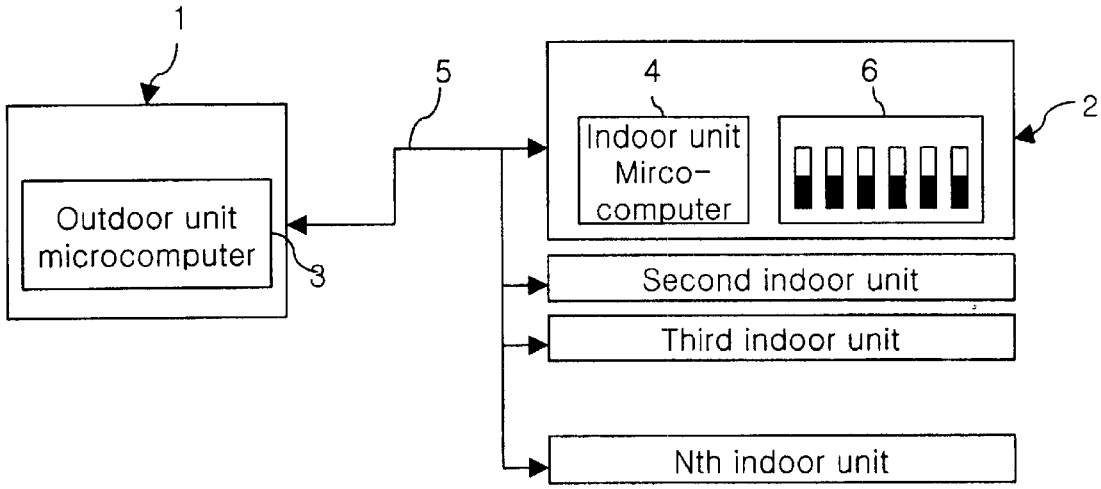
FIG. 1(Prior Art)
FIG. 1 is a block diagram showing the construction of a conventional air conditioning system.
Figure 2:
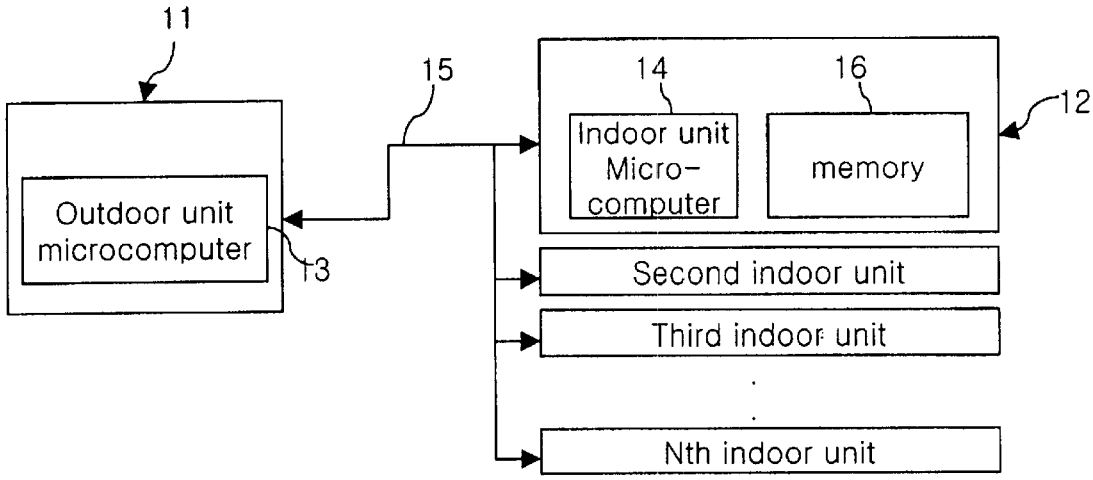
FIG. 2 is a block diagram showing the construction of an air conditioning system in accordance with the present invention.

With reference to FIG. 2, there is shown in block form the construction of an air conditioning system in accordance with the present invention. As shown in this drawing, the air conditioning system comprises one outdoor unit 11, and a plurality of indoor units 12 each connected to the outdoor unit 11 via a communication line 15. The outdoor unit 11 includes a microcomputer 13 for controlling the entire operation of the outdoor unit 11, and each of the indoor units 12 includes a microcomputer 14 for controlling the entire operation of a corresponding one of the indoor units 12. Each of the indoor units 12 further includes a memory 16, which may preferably be an electrically erasable and programmable read only memory (EEPROM). The memory 16 is adapted to store data about the operation of a corresponding one of the indoor units 12 in order to prevent the corresponding indoor unit from being subject to a data loss when an abnormal situation, such as a power failure, occurs. The memory 16 may preferably store information regarding a unique production number of the corresponding indoor unit 12.

Figure 3:
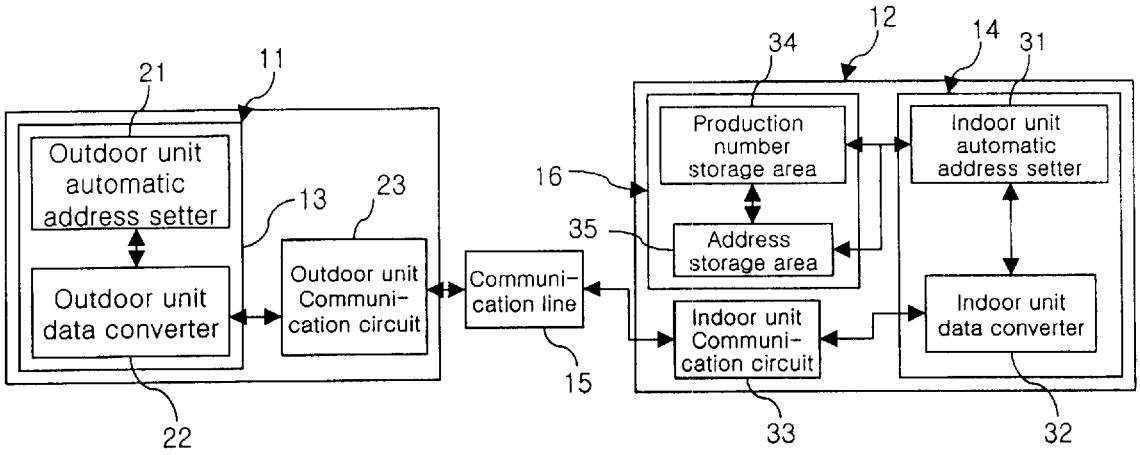
FIG. 3 is a detailed block diagram of the air conditioning system in accordance with the present invention.

The construction of the air conditioning system according to the present invention is shown in more detail in FIG. 3.

With reference to FIG. 3, the microcomputer 13 in the outdoor unit 11 includes an automatic address setter 21 for automatically setting addresses in the plurality of indoor units 12. In the present embodiment, the construction of the air conditioning system will hereinafter be described in connection with only the first indoor unit among the plurality of indoor units 12 for illustrative purposes. The outdoor unit microcomputer 13 further includes a data converter 22 for converting data transmitted and received between the outdoor unit 11 and the first indoor unit 12 into formats appropriate to standards of the communication line 15 and outdoor unit 11. A communication circuit 23 is provided in the outdoor unit 11 to transmit output data from the data converter 22 to the first indoor unit 12 over the communication line 15, and to receive data transmitted from the first indoor unit 12 over the communication line 15 and transfer the received data to the data converter 22.

The memory 16 in the first indoor unit 12 includes a production number storage area 34 for storing information regarding a production number of the first indoor unit 12, and an address storage area 35 for storing information about an address of the first indoor unit 12 set by the outdoor unit automatic address setter 21. The outdoor unit automatic address setter 21 is adapted to set the address of the first indoor unit 12 on the basis of the production number information stored in the production number storage area 34 of the memory 16. The microcomputer 14 in the first indoor unit 12 includes an automatic address setter 31 for accessing the production number storage area 34 of the memory 16 to read the production number information therefrom, and transmitting the read production number information to the outdoor unit 11 so that the address of the first indoor unit 12 can automatically be set by the outdoor unit automatic address setter 21 on the basis of the transmitted production number information. The indoor unit automatic address setter 31 also functions to store the information about the address of the first indoor unit 12 set by the outdoor unit automatic address setter 21 in the address storage area 35 of the memory 16. Similarly to the outdoor unit microcomputer 13, the indoor unit microcomputer 14 further includes a data converter 32 for converting data transmitted and received between the first indoor unit 12 and the outdoor unit 11 into formats appropriate to standards of the communication line 15 and indoor unit 12.

The first indoor unit 12 further includes a communication circuit 33 for transmitting and receiving data to/from the communication line 15. The indoor unit communication circuit 33 and the outdoor unit communication circuit 23 transmit and receive data over the communication line 15.

For the automatic setting of the address of the first indoor unit 12, the outdoor unit automatic address setter 21 first transmits a setting start signal indicative of the start of the address setting to the first indoor unit 12, and the automatic address setter 31 in the indoor unit 12 then transmits the indoor unit production number information to the outdoor unit automatic address setter 21 in response to the transmitted setting start signal. Thereafter, the outdoor unit automatic address setter 21 sets the address of the first indoor unit 12 on the basis of the indoor unit production number information transmitted from the indoor unit automatic address setter 31 and then transmits the information about the set address to the first indoor unit 12.

Upon receiving the setting start signal from the outdoor unit automatic address setter 21, the indoor unit automatic address setter 31 reads the indoor unit production number information stored in the production number storage area 34 and transmits it to the outdoor unit automatic address setter 21. The indoor unit automatic address setter 31 also stores the information about the indoor unit address, set by the outdoor unit automatic address setter 21 on the basis of the indoor unit production number information, in the address storage area 35, so that the first indoor unit 12 can transmit and receive data to/from the outdoor unit 11 on the basis of the address information stored in the address storage area 35.

Figure 4:
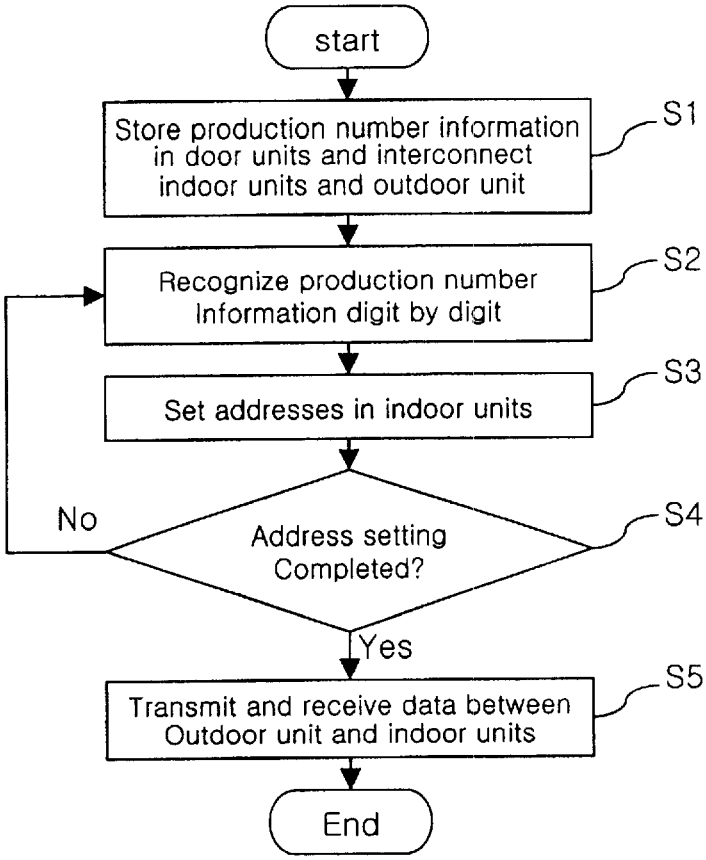
FIG. 4 is a flow chart illustrating an embodiment of a method for controlling the air conditioning system in accordance with the present invention.

FIG. 4 is a flow chart illustrating an embodiment of a method for controlling the air conditioning system in accordance with the present invention.

First, at the first step S1, information regarding production numbers of a plurality of indoor units, which are installed inside of a predefined space to perform air conditioning, are stored respectively in production number storage areas of memories of the indoor units, and an outdoor unit is connected to each of the indoor units via a communication line.

At the second step S2, upon receiving an external command for automatic address setting, the outdoor unit recognizes the production number information stored in the production number storage area of each of the indoor units digit by digit using its automatic address setter.

In detail, at the above second step S2, the outdoor unit automatic address setter recognizes the first one of a plurality of digit values constituting a production number of each of the plurality of indoor units and stores the recognized first digit value. Subsequently, the outdoor unit automatic address setter recognizes the second digit value of the production number of each indoor unit and stores the recognized second digit value. Thereafter, the outdoor unit automatic address setter repeats the digit value recognition procedure and digit value storage procedure until all the production numbers of the plurality of indoor units are recognized and stored.

At the third step S3, upon recognizing all the production numbers of the plurality of indoor units at the above second step S2, the outdoor unit automatic address setter maps addresses to the indoor units on the basis of the recognized production numbers so as to set the addresses in the indoor units, respectively.

At the fourth step S4, the outdoor unit determines whether all the production numbers of the plurality of indoor units have been recognized. In this embodiment, information about the production numbers of the indoor units are stored in a memory (not shown) assigned previously to the outdoor unit automatic address setter. In this regard, provided that the number of production numbers storable in the memory is equal to that of the indoor units, the completely full state of the memory will signify that all the production numbers of the indoor units have been recognized. Alternatively, information about the number of the indoor units may be prestored in the outdoor unit. In this case, if the same number of addresses as the prestored number have been set in the indoor units, the outdoor unit will recognize that the address setting has been completed with respect to all the indoor units. If the address setting has not been completed, the outdoor unit returns to the above second step S2.

At the fifth step S5, after the address setting is completed at the above fourth step S4, automatic address setters of the indoor units store the addresses set by the outdoor unit automatic address setter in address storage areas of the indoor units, respectively. As a result, the outdoor unit and the indoor units can transmit and receive data on the basis of the stored addresses.

Figure 5:
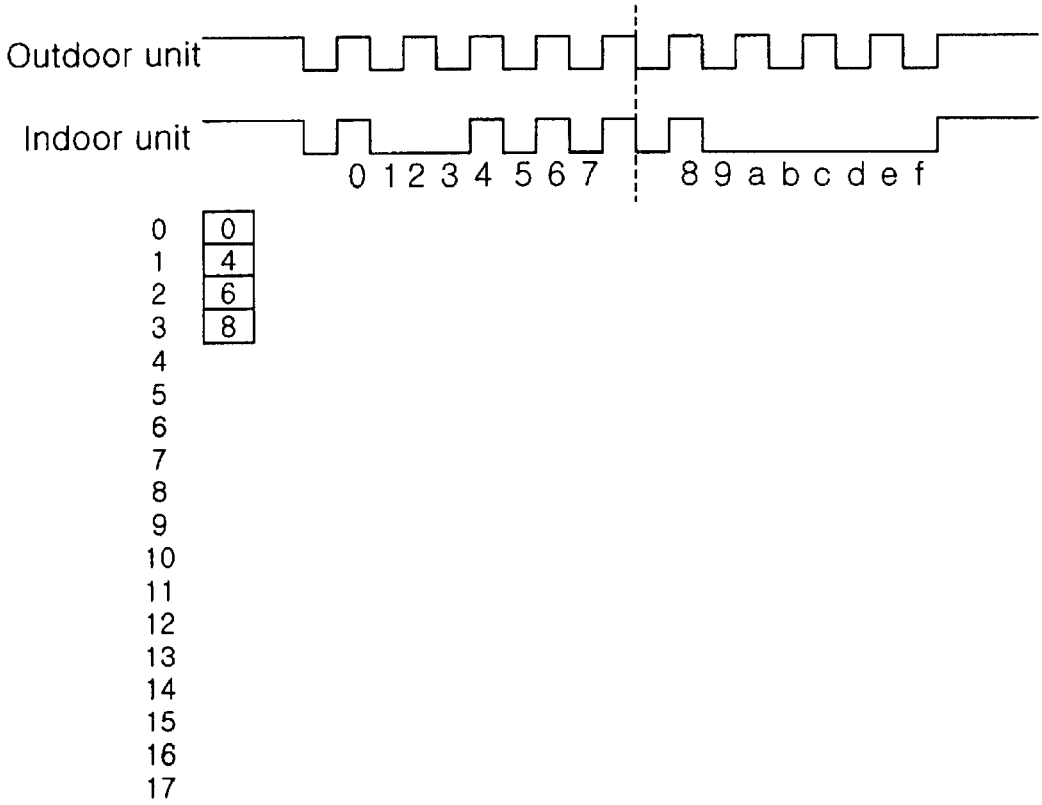
FIG. 5 is a view illustrating in a bar form the recognition of a first digit value of a production number of each indoor unit by an outdoor unit according to the control method of FIG. 4.
Figure 6:
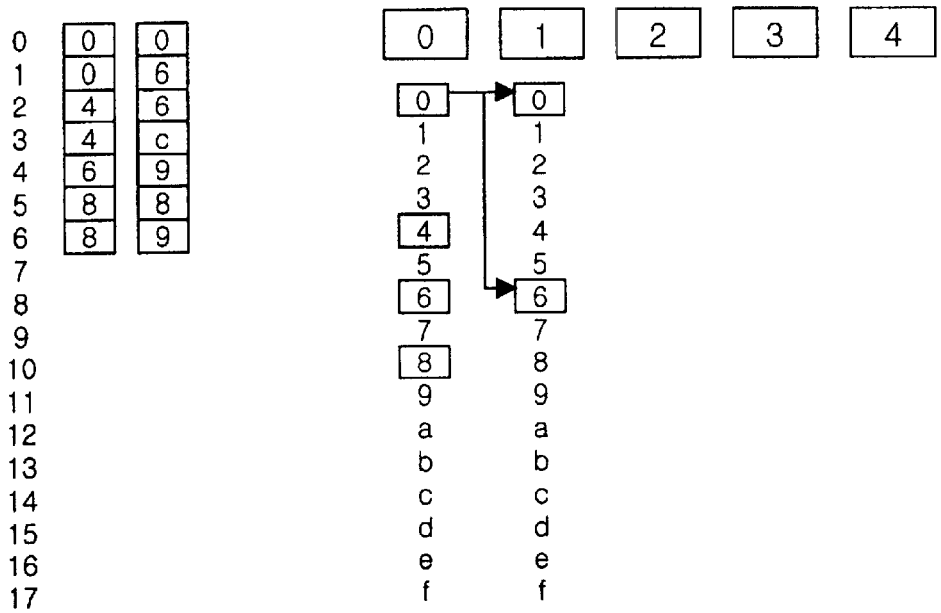
FIG. 6 is a view illustrating in a bar form the recognition of a second digit value of the production number of each indoor unit by the outdoor unit according to the control method of FIG. 4.
Figure 7:
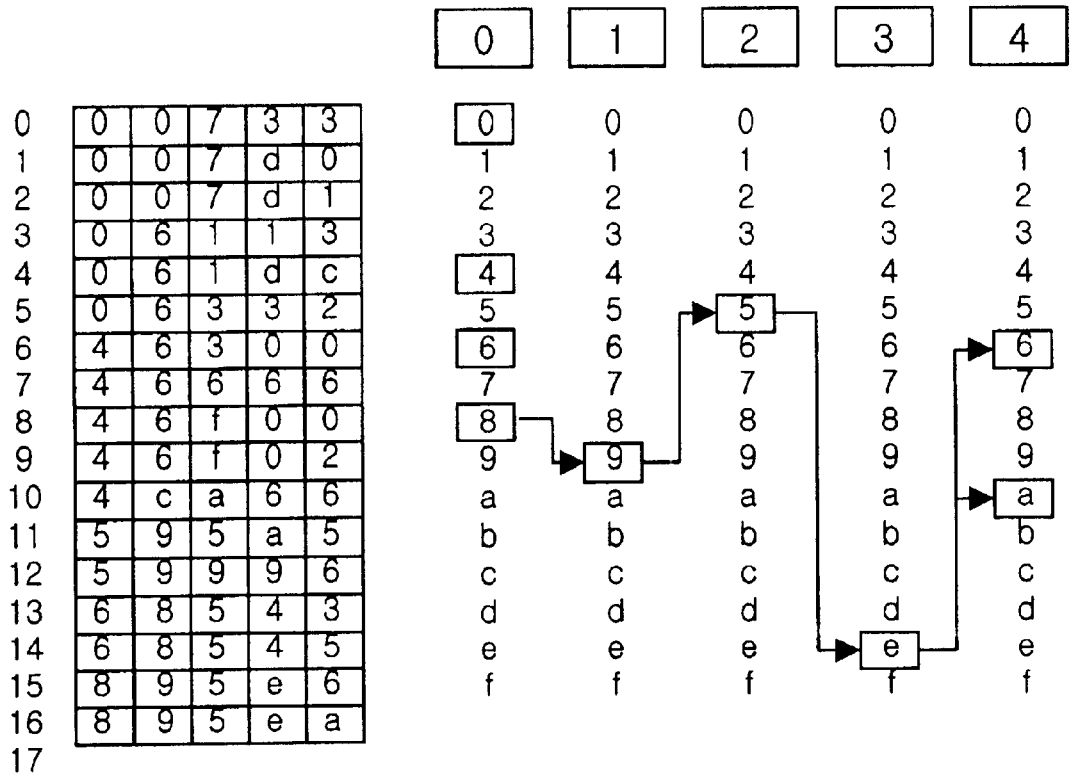
FIG. 7 is a view illustrating in a bar form the recognition of a last digit value of the production number of each indoor unit by the outdoor unit according to the control method of FIG. 4.

FIGS. 5, 6 and 7 show waveforms of signals generated based on the address setting operation of the air conditioning system according to the present invention to explain the concept of the address setting operation.

Assume that the production number storage areas of the plurality of indoor units have 4-bit memory capacities and the production numbers of the indoor units are each composed of 5 digits. First, the outdoor unit forces the automatic address setter thereof to execute the automatic address setting. At this time, the plurality of indoor units connected to the outdoor unit are still not assigned addresses.

FIG. 5 shows a waveform of an output signal from the outdoor unit and a waveform of an output signal from each of the plurality of indoor units, which is transmitted to the outdoor unit in response to the output signal from the outdoor unit, according to the present invention. The outdoor unit requests each of the indoor units to transmit the first or last digit value (the first digit value in the present embodiment) of the 5-digit number, and each indoor unit transmits the first digit value of its production number stored in the production number storage area to the outdoor unit in response to the transmission request from the outdoor unit.

In other words, if the outdoor unit transmits an address setting start signal which is followed by signals, for example, 0 to f, then each of the indoor unit automatic address setters transmits an acknowledgement signal to the outdoor unit only when the first digit value of the corresponding production number is equal to any one of the signals 0 to f transmitted from the outdoor unit. In the case where the first digit values of the production numbers of the plurality of indoor units are, for example, 0, 4, 6 and 8, respectively, the indoor units transmit acknowledgement signals as shown in FIG. 5. In response to the acknowledgement signals from the indoor units, the outdoor unit automatic address setter temporarily stores the digit values acknowledged by the indoor units, as shown in FIG. 5, in its memory.

FIG. 6 illustrates a procedure where the outdoor unit recognizes and stores the second digit values of the production numbers after completing the recognition of the first digit values thereof. In this procedure, because the outdoor unit has already recognized in the procedure of FIG. 5 that the first digit values of the production numbers of the plurality of indoor units are nothing but 0, 4, 6 and 8, it first recognizes the second digit value of the indoor unit production number whose first digit value is 0 and then the second digit value of the indoor unit production number whose first digit value is 4.

FIG. 7 illustrates production numbers, stored in the memory of the outdoor unit automatic address setter after the above procedure is repeated, and the last search procedure performed by the outdoor unit. The outdoor unit automatic address setter sequentially stores information regarding the recognized indoor unit production numbers in a predefined space of the memory and then maps addresses to the indoor units on the basis of the recognized production numbers to set the addresses in the indoor units, respectively. As a result, the automatic address setting operation is completed.

After the addresses are set in the plurality of indoor units, the outdoor unit can control the indoor units by means of the set addresses and identify a desired one of the indoor units, to be controlled, on the basis of a corresponding one of the set addresses.

Figure 8:
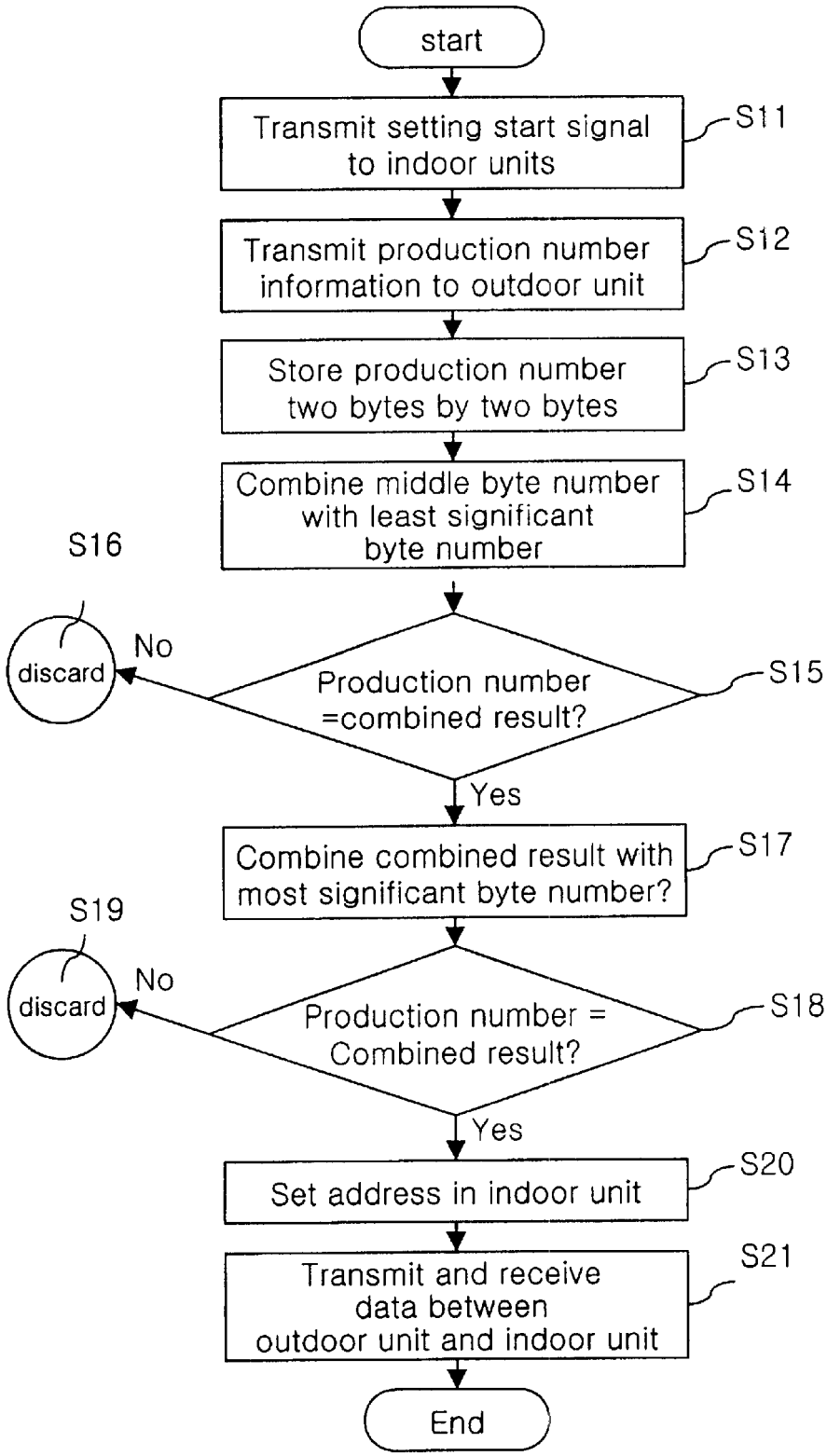
FIG. 8 is a flow chart illustrating an alternative embodiment of the method for controlling the air conditioning system in accordance with the present invention.

FIG. 8 is a flow chart illustrating an alternative embodiment of the method for controlling the air conditioning system in accordance with the present invention.

First, at the eleventh step S11, the outdoor unit transmits a setting start signal indicative of the start of the automatic address setting to the plurality of indoor units.

At the twelfth step S12, each of the indoor units transmits information regarding the production number stored in its production number storage area to the outdoor unit in response to the setting start signal transmitted at the above eleventh step S11.

At the thirteenth step S13, in the case where the production number transmitted from each of the indoor units is composed of, for example, 6 bytes, the outdoor unit classifies the transmitted production number into a least significant byte number, which is composed of bytes 4 and 5 of the production number, a middle byte number, which is composed of bytes 2 and 3 of the production number, and a most significant byte number, which is composed of bytes 0 and 1, and then stores the classified byte numbers.

At the fourteenth step S14, the outdoor unit combines the middle byte number with the least significant byte number.

At the fifteenth step S15, the outdoor unit determines which one of the production numbers of the indoor units has a middle byte number and least significant byte number equal to the result combined at the above fourteenth step S14.

At the sixteenth step S16, if it is determined at the above fifteenth step S15 that none of the production numbers of the indoor units has the middle byte number and least significant byte number equal to the combined result, the outdoor unit discards the combined result.

At the seventeenth step S17, if it is determined at the above fifteenth step S15 that any one of the production numbers of the indoor units has the middle byte number and least significant byte number equal to the combined result, the outdoor unit combines the combined result with the most significant byte number.

At the eighteenth step S18, the outdoor unit determines which one of the production numbers of the indoor units is equal to the result combined at the above seventeenth step S17.

At the nineteenth step S19, if it is determined at the above eighteenth step S18 that none of the production numbers of the indoor units is equal to the combined result, the outdoor unit discards the combined result.

At the twentieth step S20, if it is determined at the above eighteenth step S18 that any one of the production numbers of the indoor units is equal to the combined result, the outdoor unit recognizes and stores the combined result as the production number of the corresponding indoor unit and then sets an address in the corresponding indoor unit.

At the twenty-first S21, the corresponding indoor unit and the outdoor unit are interconnected to transmit and receive data to/from each other.

FIGS. 9*a*, 9*b* and 9*c* show in a bar form the results that the outdoor unit automatic address setter obtains by, according to the second embodiment of the present control method, searching for the least significant byte numbers, which are composed of the fifth and sixth digit values ƒ and | of the production numbers of the plurality of indoor units, the middle byte numbers, which are composed of the third and fourth digit values ™ and Σ of the production numbers, and the most significant byte numbers, which are composed of the first and second digit values ® and © of the production numbers.

The outdoor unit combines the least significant byte numbers with the middle byte numbers as shown in FIG. 10*a* and compares the combined results with the production numbers stored in the indoor units to determine whether they are equal. If the combined results are equal to the production numbers, the outdoor unit combines the combined results with the most significant byte numbers as shown in FIG. 10*b*.

As apparent from the above description, the present invention provides an air conditioning system (multi-air conditioner system) which has a plurality of indoor units installed inside of a predefined space for performing air conditioning and an outdoor unit installed outside of the space for controlling the indoor units, and a method for controlling the same. In an installation process, an installer need not personally set addresses in the indoor units one by one, because the outdoor unit automatically sets the addresses in the indoor units. Therefore, as compared with conventional air conditioning systems, a period of time required for the address setting and an error occurrence probability can be reduced and the convenience to the user can be increased. Furthermore, the address setting can automatically be conducted without additionally using separate hardware modules, thereby reducing parts costs required in manufacturing a multi-air conditioner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for controlling an air conditioning system, comprising the steps of:

a) storing information in a plurality of indoor air conditioning units, said information being about unique production numbers assigned respectively to the indoor units during manufacturing processes of said indoor units;

b) recognizing the production number information stored in said indoor units on a digit by digit basis with an outdoor unit controlling said plurality of indoor units, wherein said step b) includes the steps of b-1) recognizing a first one of a plurality of digit values constituting each of said production numbers;

b-2) storing the recognized first digit value;

b-3) recognizing and storing a subsequent digit value of each of said production numbers; and b-4) repeating said step b-3) until all said production numbers are recognized and stored;

c) setting addresses in said indoor units with said outdoor unit on the basis of said production number information if all said production number information have been recognized at said step b); and d) transmitting and receiving data between said outdoor unit and said indoor units on the basis of the addresses set by said outdoor unit at said step c).

2. A method for controlling an air conditioning system, comprising the steps of:

a) storing information in a plurality of indoor air conditioning units, said information being about unique production numbers assigned respectively to the indoor units during manufacturing processes of said indoor units;

b) recognizing the production number information stored in said indoor units on a digit by digit basis with an outdoor unit controlling said plurality of indoor units;

c) setting addresses in said indoor units with said outdoor unit on the basis of said production number information if all said production number information have been recognized at said step b); and d) transmitting and receiving data between said outdoor unit and said indoor units on the basis of the addresses set by said outdoor unit at said step c), wherein said step d) includes the steps of d-1) storing said addresses set by said outdoor unit at said step c) with said indoor units, respectively; and d-2) identifying a desired one of said indoor units to be controlled on the basis of a corresponding one of the set addresses with said outdoor unit.

3. A method for controlling an air conditioning system, comprising the steps of:

a) storing in a plurality of indoor units information about unique production numbers assigned respectively to the indoor units in manufacturing processes thereof;

b) allowing an outdoor unit controlling said plurality of indoor units to recognize the production number information stored in said indoor units on a digit by digit basis;

c) allowing said outdoor unit to combine the recognized production number information and then determine which one of said production numbers of said indoor units is equal to the combined result;

d) allowing said outdoor unit to set an address in anyone of said indoor units corresponding to the specific production number if it is determined at said step c) that a specific one of said production numbers of said indoor units is equal to the combined result;

e) allowing said outdoor unit to assign the set address to said indoor unit corresponding to said specific production number;

f) repeating said steps c) to e) until all said indoor units are assigned addresses; and g) allowing said outdoor unit to control said indoor units on the basis of the addresses assigned thereto.

4. The method as set forth in claim 3, wherein said step c) includes the step of combining said production number information on a byte basis.

5. The method as set forth in claim 3, wherein said step e) includes the step of allowing said indoor unit corresponding to said specific production number to store the assigned address.

6. The method as set forth in claim 3, wherein said step g) includes the step of identifying said indoor units on the basis of said addresses assigned thereto to transmit and receive data to/from said indoor units.

7. An air conditioning system comprising:

a plurality of indoor air conditioning units each adapted to suck indoor air, perform a heat exchange operation for the sucked indoor air with a heat exchange medium and discharge the heat exchanged air, each of said indoor units including a production number storage area defined in a memory which is installed to prevent a corresponding one of said indoor units from being subjected to a data loss when a power failure occurs, said production number storage area storing information about a unique production number assigned to said corresponding indoor unit during a manufacturing process of said corresponding indoor unit; and an outdoor air conditioning unit connected in common to said plurality of indoor units and adapted to perform a heat exchange operation for the heat exchange medium with external air, said outdoor unit setting addresses in said indoor units to control them, respectively wherein said outdoor unit includes:

an outdoor unit automatic address setter for automatically setting the addresses in said indoor units;

an outdoor unit data converter for converting data transmitted and received between said outdoor unit and said indoor units into formats appropriate to standards of a communication line and said outdoor unit; and an outdoor unit communication circuit for transmitting output data from said outdoor unit data converter to said indoor units and for receiving data transmitted from said indoor units and transferring the received data to said outdoor unit data converter; and wherein each of said indoor units includes:

an indoor unit automatic address setter for transmitting said production number information stored in said production number storage area to said outdoor unit in response to data transmitted from said outdoor unit automatic address setter;

an address storage area for storing a corresponding one of said addresses set by said outdoor unit automatic address setter;

an indoor unit data converter for converting data transmitted and received between said corresponding indoor unit and said outdoor unit into formats appropriate to the standard of said communication line and a standard of said corresponding indoor unit; and an indoor unit communication circuit for transmitting output data from said indoor unit data converter to said outdoor unit and for receiving data transmitted from said outdoor unit and transferring the received data to said indoor unit data converter, wherein said outdoor unit automatic address setter is adapted to transmit a setting start signal indicative of the start of an address setting operation to said plurality of indoor units, set said addresses of said indoor units on the basis of the indoor unit production number information transmitted from said indoor units in response to the setting start signal, and then transmit information about the set addresses respectively to said indoor units; and wherein said indoor unit automatic address setter is adapted to transmit said indoor unit production number information to said outdoor unit automatic address setter in response to said setting start signal and store a corresponding one of the address information transmitted from said outdoor unit automatic address setter in said address storage area.

8. The air conditioning system as set forth in claim 7, wherein said outdoor unit automatic address setter is further adapted to temporarily store said indoor unit production number information transmitted from said indoor units, map said addresses to the temporarily stored production number information after recognizing all the production numbers of said indoor units and then set the mapped addresses in said indoor units, respectively.

* * * * *